US008317270B2

(12) United States Patent
Tseng

(10) Patent No.: US 8,317,270 B2
(45) Date of Patent: Nov. 27, 2012

(54) BACKREST DEVICE FOR A CHAIR

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 15 days.

(21) Appl. No.: 12/961,642

(22) Filed: Dec. 7, 2010

(65) Prior Publication Data

US 2012/0139323 A1 Jun. 7, 2012

(51) Int. Cl.
*A47C 7/02* (2006.01)
*A47C 7/00* (2006.01)

(52) U.S. Cl. ..... 297/452.2; 297/440.11

(58) Field of Classification Search ..... 297/452.2, 297/226, 440.11, 452.56
See application file for complete search history.

(56) References Cited

U.S. PATENT DOCUMENTS 2,509,451 A * 5/1950 Reinholz ..... 297/287
3,586,376 A * 6/1971 Le Mire ..... 297/452.2
5,735,572 A * 4/1998 Clark et al. ..... 297/216.13
5,911,478 A * 6/1999 Goodman ..... 297/440.11
6,585,323 B2 * 7/2003 Gaylord et al. ..... 297/440.11
6,779,849 B1 * 8/2004 Harper et al. ..... 297/452.13

* cited by examiner

*Primary Examiner* — Milton Nelson, Jr.
(74) *Attorney, Agent, or Firm* — Trop, Pruner & Hu, P.C.

(57) ABSTRACT

A backrest device for a chair includes two lateral pipe units, each including a backrest mounting pipe member and a coupling pipe member, and a backrest unit. The backrest mounting pipe member has a main surrounding wall defining a surrounding space therein, and a convex groove-defining wall disposed in the surrounding space and defining an engaging groove therein. The coupling pipe member has a coupling surrounding wall coupled to a lower end of the main surrounding wall, and an abutting wall for closing a top end of the coupling surrounding wall. The backrest unit includes a backrest member having opposite lateral portions each forming a rod-receiving loop, and two positioning rods sleeved respectively in the rod-receiving loops. Each lateral portion and a respective positioning rod are retained within the engaging groove of a corresponding pipe unit.

2 Claims, 4 Drawing Sheets

BACKREST DEVICE FOR A CHAIR

BACKGROUND OF THE INVENTION

1. Field of the Invention

The invention relates to a backrest device for a chair, more particularly to a backrest device having a backrest member that can be maintained at an original height position after long-term use.

2. Description of the Related Art

Referring to FIG. 1, a conventional backrest device for a chair comprises a pair of spaced-apart backrest mounting pipe members 3, and a backrest unit 4.

Each of the pipe members 3 has a main surrounding wall 31 and a groove-defining wall 32. The main surrounding wall 31 defines a surrounding space 311 and is formed with an opening 323 extending longitudinally from an upper end to a lower end of the main surrounding wall 31. The groove-defining wall 32 is disposed in the surrounding space 311, has opposite wall ends connected respectively to opposite ends of the main surrounding wall 31 so as to define the opening 323 therebetween, and defines and engaging groove 321 therein. The engaging groove 321 of each of the pipe members 3 has a top open end 322 at the upper end 312 of the main surrounding wall 31 of a corresponding one of the pipe members 3.

The backrest unit 4 includes a backrest member 41 having opposite lateral portions 412, each of which forms a rod-receiving loop 411, and a pair of positioning rods 42 sleeved respectively in the rod-receiving loops 411.

When assembling the conventional backrest device, each of the lateral portions 412 of the backrest member 41 and the respective one of the positioning rods 42 are inserted downwardly into the engaging groove 321 of the respective one of the pipe members 3 through the top open end 322 of the engaging groove 321 of the respective pipe member 3 to thereby be retained within the respective engaging groove 321. As such, the backrest member 41 is stretched, and the lateral portions 412 and the corresponding positioning rods 42 are maintained at an original height position by virtue of the elasticity of the backrest member 41.

However, since the backrest member 41 may become loose after long-term use, the backrest member 41 has a tendency to fall toward lower ends of the main surrounding walls 31, thus resulting in inconvenience during use.

Furthermore, dust may easily accumulate in the surrounding spaces 311 of the pipe members 3 through the top open ends 322 of the pipe members 3.

SUMMARY OF THE INVENTION

Therefore, the object of the invention is to provide a backrest device for a chair capable of alleviating the above drawback of the prior art.

Accordingly, the backrest device for a chair of the present invention includes a pair of lateral pipe units spaced apart from each other along a left-right direction, and a backrest unit. Each of the lateral pipe units includes a backrest mounting pipe member and a coupling pipe member. The backrest mounting pipe member has a hollow main surrounding wall that a middle segment, and a pair of symmetric extending segments extending respectively from opposite circumferential ends of the middle segment and cooperating with the middle segment to defines a surrounding space thereamong, and a groove-defining wall that is disposed in the surrounding space, that has a convex configuration toward the middle segment of the main surrounding wall with opposite ends thereof connected respectively to the extending segments of the main surrounding wall, that extends from an upper end toward a lower end of the main surrounding wall, and that defines an engaging groove therein. The coupling pipe member has a coupling surrounding wall that is coupled to the lower end of the main surrounding wall of the backrest mounting pipe member, and an abutting wall that is disposed to close a top end of the coupling surrounding wall. The backrest unit includes a backrest member having opposite lateral portions, each of which forms a rod-receiving loop, and a pair of positioning rods sleeved respectively in the rod-receiving loops. Each of the lateral portions of the backrest member and a respective one of the positioning rods are retained within the engaging groove of a respective one of the backrest mounting pipe members and abut against the abutting wall of the coupling pipe member of a corresponding one of the lateral pipe units.

BRIEF DESCRIPTION OF THE DRAWINGS

Other features and advantages of the invention will become apparent in the following detailed description of the preferred embodiment with reference to the accompanying drawings, of which.

DETAILED DESCRIPTION OF THE PREFERRED EMBODIMENTS

Figure 1:
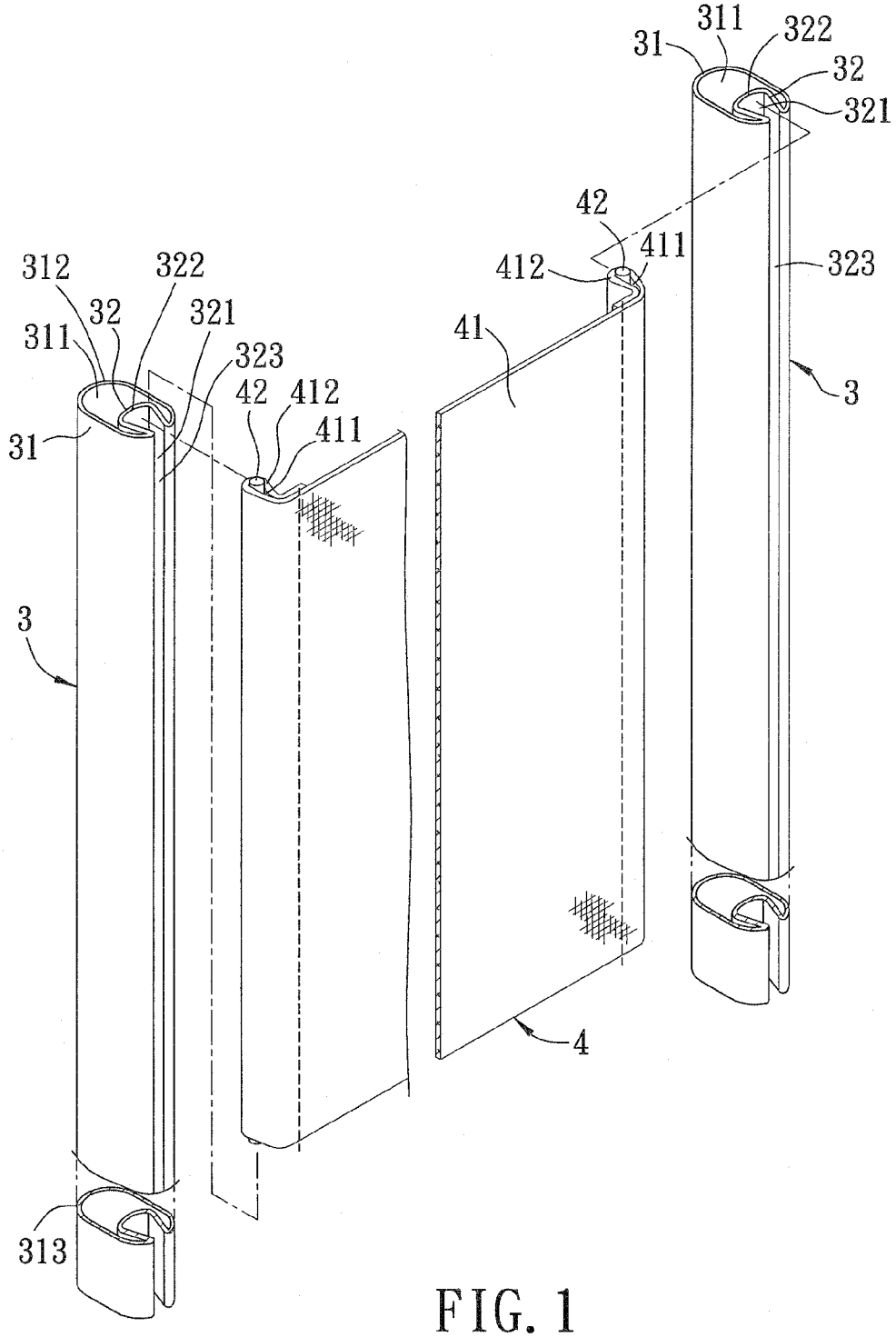
FIG. 1 PRIOR ART
FIG. 1 is a fragmentary exploded perspective view of a conventional backrest device.
Figure 2:
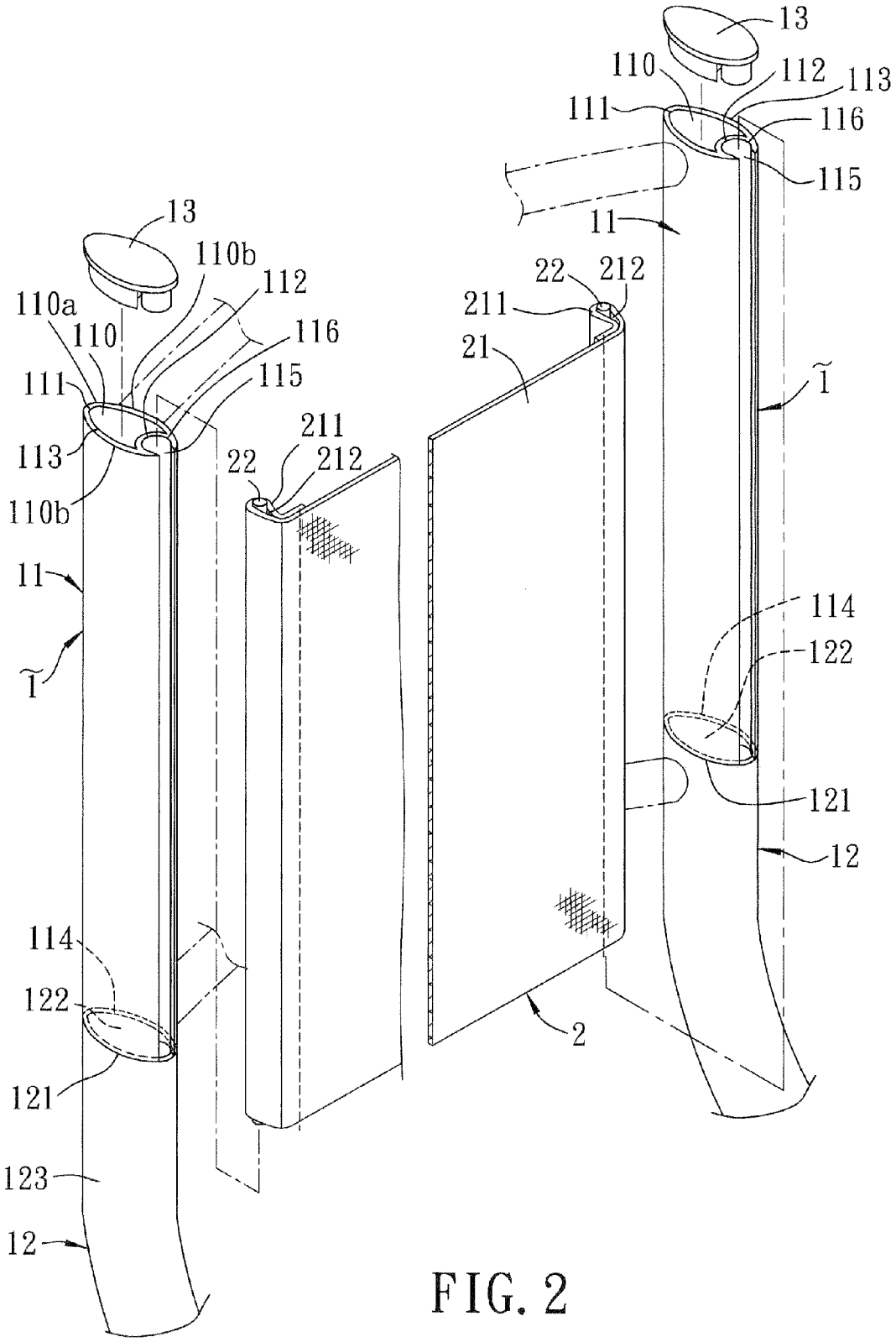
FIG. 2 is a fragmentary exploded perspective view of a preferred embodiment of a backrest device according to the present invention.
Figure 3:
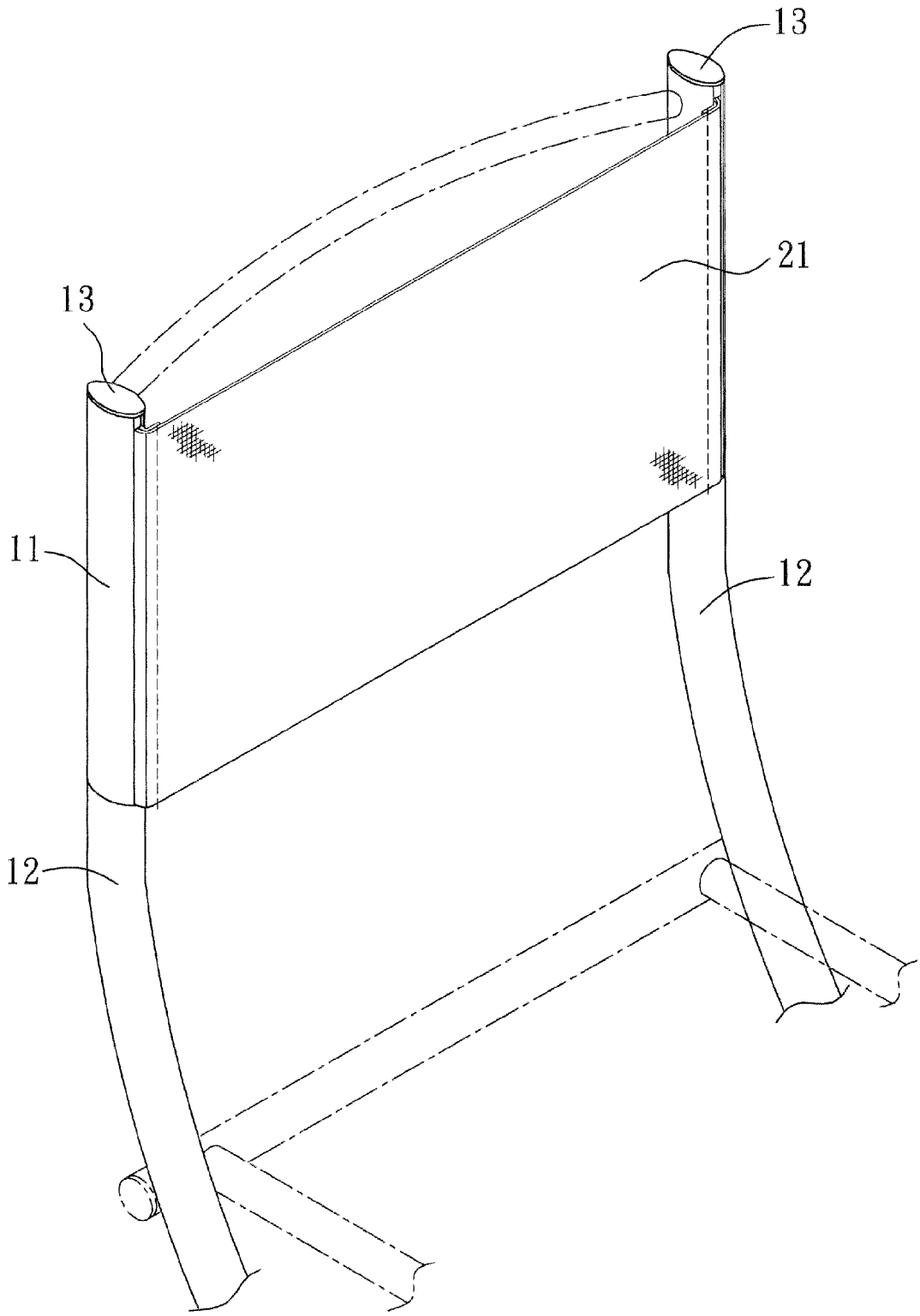
FIG. 3 is a perspective view of the preferred embodiment.
Figure 4:
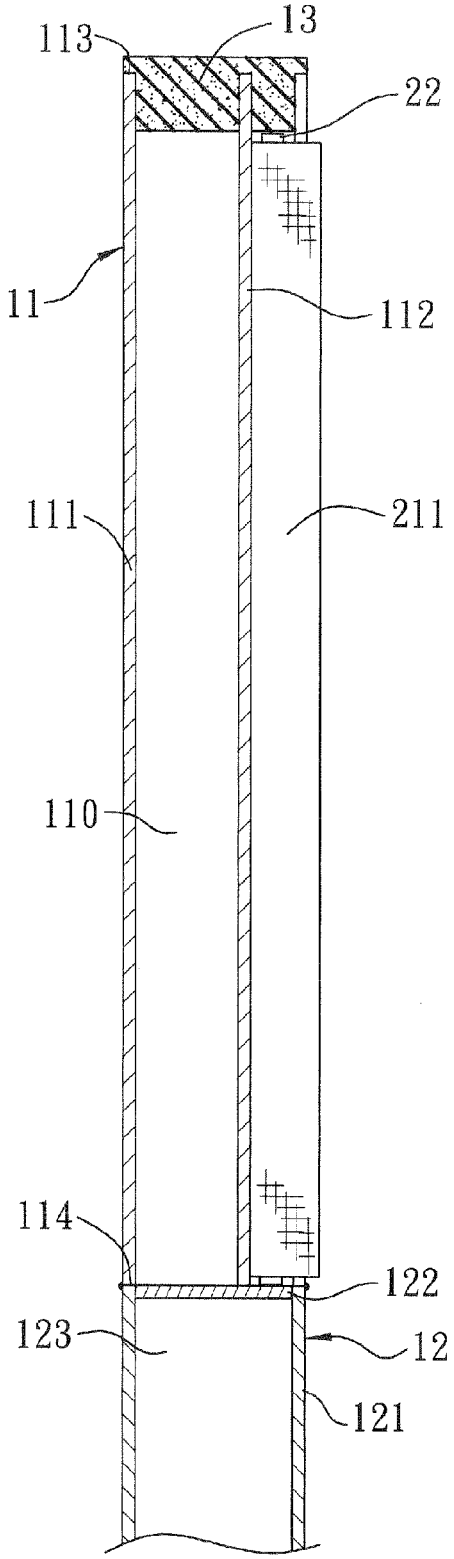
FIG. 4 is a fragmentary sectional view of a lateral pipe unit of the preferred embodiment.

Referring to FIGS. 2 to 4, a preferred embodiment of a backrest device of the present invention is shown. The backrest device includes a pair of lateral pipe units 1 spaced apart from each other along a left-right direction and a backrest unit 2. Each of the lateral pipe units 1 includes an upright backrest mounting pipe member 11 and a coupling pipe member 12. In this embodiment, the backrest mounting pipe members 11 and the coupling pipe members 12 of the lateral pipe units 1 are made of metal.

The backrest mounting pipe member 11 of each of the lateral pipe units 1 has a hollow main surrounding wall 111 and a groove-defining wall 112. Each of the main surrounding walls 111 has a middle segment **110*a*, and a pair of symmetric extending segments 110*b* extending respectively from opposite circumferential ends of the middle segment 110*a* and cooperating with the middle segment 110*a* to define an elliptical surrounding space 110 thereamong. For each lateral pipe unit 1, the groove-defining wall 112 is disposed in the surrounding space 110 of the main surrounding wall 111, has a convex configuration toward the middle segment 110*a* of the main surrounding wall 111 of the backrest mounting pipe members 11 with opposite ends thereof connected respectively to the extending segments 110*b* of the main surrounding wall 111 of the backrest mounting pipe members 11. The groove-defining wall 112 extends from an upper end 113 toward a lower end 114 of the main surrounding wall 111, and defines an engaging groove 115 therein. The engaging groove 115 has a top open end 116 at the upper end 113 of the main surrounding wall 111**.

For each of the lateral pipe units 1, the coupling pipe member 12 has a coupling surrounding wall 121 that defines a lower space 123 therein and that is coupled to the lower end 114 of the main surrounding wall 111 of the backrest mounting pipe members 11 and an abutting wall 122 that is disposed to close a top end of the coupling surrounding wall 121. In this embodiment, the backrest mounting pipe members 11 is welded to the coupling pipe member 12. After the welding process, the backrest mounting pipe member 11 and the coupling pipe member 12 are further polished and spray-painted, so that they appear to be integrally formed. Furthermore, the abutting wall 122 is welded to the coupling surrounding wall 121 to separate the lower space 123 of the coupling pipe member 12 from the surrounding space 110 of the backrest mounting pipe member 11.

The backrest unit 2 includes a backrest member 21 having opposite lateral portions 211, each of which forms a rod-receiving loop 212 and a pair of positioning rods sleeved respectively in the rod-receiving loops 212. In this embodiment, the backrest member 21 is made of elastic fabric such as plastic film or canvas, and the positioning rods 22 are made of plastic or metal material. The lateral port ions 211 of the backrest member 21 are folded and sewn to form the rod-receiving loops 212, respectively.

The lateral pipe units 1 further include two caps 13. Each of the caps is coupled to the upper end 113 of a respective one of the backrest mounting pipe members 11 for sealing the surrounding space 110 and the top open end 116 of the engaging groove 115 of the corresponding one of the backrest mounting pipe members 11.

When assembling the backrest device, the positioning rods 22 are first sleeved respectively in the rod-receiving loops 212. Afterwards, each of the lateral portions 211 of the backrest member 21 and the respective one of the positioning rods 22 are inserted downwardly into the engaging groove 115 of a respective one of the backrest mounting pipe members 11 through the top open end 116 of the corresponding engaging groove 115 so as to be retained within the corresponding engaging groove 115 and to abut against the abutting wall 122 of the coupling pipe member 12 of a corresponding one of the lateral pipe units 1. Finally, the caps 13 are coupled respectively to the upper ends 113 of the backrest mounting pipe members 11.

To sum up, the advantages of the backrest device of the present invention are as follows. For each of the lateral pipe units 1, the lateral portion 211 of the backrest member 21 and the respective the positioning rod 22 abut against the abutting wall 122 of the coupling pipe member 12 to thereby keep the backrest member 41 in place without falling toward the lower end 313 of the main surrounding wall 11 during use. Furthermore, the cap 13 seals the surrounding space 110 and the top open end 116 of the engaging groove 115 of the backrest mounting pipe member 11, thereby avoiding dust accumulation in the surrounding spaces 110.

While the invention has been described in connection with what is considered the most practical and embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A backrest device for a chair comprising:

a pair of lateral pipe units spaced apart from each other along a left-right direction, each of said lateral pipe units including:

an upright backrest mounting pipe member having a hollow main surrounding wall that has, a middle segment, and a pair of symmetric extending segments extending respectively from opposite circumferential ends of said middle segment and cooperating with said middle segment to define a surrounding space thereamong;

a groove-defining wall that is disposed in said surrounding space, that has a convex configuration facing toward said middle segment of said main surrounding wall with opposite ends thereof connected respectively to said extending segments of said main surrounding wall, that extends from an upper end toward a lower end of said main surrounding wall, and that defines an engaging groove therein;

a coupling pipe member having a coupling surrounding wall that is coupled to said lower end of said main surrounding wall of said backrest mounting pipe member;

an abutting wall that is disposed to close a top end of said coupling surrounding wall;

a backrest unit including a backrest member having opposite lateral portions, each of which forms a rod-receiving loop;

a pair of positioning rods sleeved respectively in said rod-receiving loops; and each of said lateral portions of said backrest member and a respective one of said positioning rods being retained within said engaging groove of said backrest mounting pipe members of a respective one of said lateral pipe units and abutting against said abutting wall of said coupling pipe member of a corresponding one of said lateral pipe units.

2. The backrest device for a chair as claimed in claim 1, wherein said engaging groove of said backrest mounting pipe member of each of said lateral pipe units has a top open end at said upper end of said main surrounding wall of said backrest mounting pipe members of a corresponding one of said lateral pipe units for extension of the corresponding lateral portion of said backrest member and the corresponding positioning rod therethrough, each of said lateral pipe units further including a cap that is coupled to said upper end of said backrest mounting pipe members of a corresponding one of said lateral pipe units for sealing said surrounding space and said top open end of said engaging groove of said backrest mounting pipe member of the corresponding one of said lateral pipe units.

* * * * *